US010022851B2

(12) United States Patent
Schaub et al.

(10) Patent No.: US 10,022,851 B2
(45) Date of Patent: Jul. 17, 2018

(54) CORDLESS ANCHOR SETTING TOOL BIT RETENTION DEVICE

(71) Applicant: BLACK & DECKER INC., Newark, DE (US)

(72) Inventors: Michael J. Schaub, Nottingham, MD (US); James R. Parks, White Hall, MD (US); Richard J. Heavel, Hanover, PA (US)

(73) Assignee: Black & Decker, Inc., Newark, DE (US)

( * ) Notice: Subject to any disclaimer, the term of this patent is extended or adjusted under 35 U.S.C. 154(b) by 554 days.

(21) Appl. No.: 14/628,698

(22) Filed: Feb. 23, 2015

(65) Prior Publication Data

US 2015/0239114 A1 Aug. 27, 2015

Related U.S. Application Data

(60) Provisional application No. 61/944,843, filed on Feb. 26, 2014.

(51) Int. Cl.
*B25D 17/08* (2006.01)
*B25D 11/06* (2006.01)

(52) U.S. Cl.
CPC ..... *B25D 17/08* (2013.01); *B25D 11/068* (2013.01); *Y10T 29/49863* (2015.01); *Y10T 279/17461* (2015.01)

(58) Field of Classification Search
CPC ..... B23B 31/10; B25B 21/02; B25D 17/08; B25D 11/068; B27F 7/00; B24B 7/00
USPC ..... 173/1, 109, 205, 217; 227/147, 139
See application file for complete search history.

(56) References Cited

U.S. PATENT DOCUMENTS

| | | | | |
|---|---|---|---|---|
| 1,425,482 A | | 8/1922 | James | |
| 1,605,941 A | | 11/1926 | Hansen | |
| 1,647,201 A | * | 11/1927 | Smickle | B25D 17/08 279/19 |
| 1,755,269 A | | 4/1930 | Pearson | |
| 1,770,680 A | | 7/1930 | Tuttle | |
| 1,776,922 A | | 9/1930 | Naismith | |
| 1,832,471 A | | 11/1931 | Nell | |
| 2,055,898 A | | 9/1936 | Huffman | |
| 2,265,427 A | | 12/1941 | Fuehrer | |
| 2,357,045 A | | 8/1944 | Hauer | |
| 2,406,514 A | | 8/1946 | Squire | |
| 2,489,923 A | | 11/1949 | Nast | |
| 3,579,912 A | * | 5/1971 | Panko | B23B 31/10 269/268 |
| 3,865,198 A | | 2/1975 | Price | |
| 4,007,795 A | | 2/1977 | Gawron et al. | |
| 4,162,065 A | | 7/1979 | Rea | |

(Continued)

OTHER PUBLICATIONS

Matzdorf, Udo—European Search Report re: corresponding application EP15156649—dated Jul. 16, 2015—8 pages.

*Primary Examiner* — Nathaniel Chukwurah
(74) *Attorney, Agent, or Firm* — Rhonda L. Barton

(57) ABSTRACT

A bit retention device has an upper support member having an inner surface and an outer surface. A lower support member fixed to the upper support member. A stationary plate is mounted to the inner surface of the upper support member. A clamp plate opposes the stationary plate and is spring biased toward the stationary plate and slidably moveable between the upper support member and the lower support member.

11 Claims, 10 Drawing Sheets

(56) References Cited

U.S. PATENT DOCUMENTS

| | | | | |
|---|---|---|---|---|
| 4,231,580 | A | 11/1980 | Emonet | |
| 4,878,679 | A | 11/1989 | Plank et al. | |
| 5,354,075 | A * | 10/1994 | Marik | B23B 31/226 279/131 |
| 7,147,546 | B1 * | 12/2006 | Dovel | B24B 3/247 451/231 |
| 2010/0089969 | A1 | 4/2010 | Fukinuki et al. | |

* cited by examiner

CORDLESS ANCHOR SETTING TOOL BIT RETENTION DEVICE

CROSS-REFERENCE TO RELATED APPLICATIONS

The present application claims priority under 35 U.S.C. § 119 to U.S. Provisional Patent Application Ser. No. 61/944,843 filed on Feb. 26, 2014, entitled Cordless Anchor Setter Bit Retention, which is herein incorporated by reference in its entirety.

BACKGROUND OF THE INVENTION

Field of the Invention

The present invention relates, in general, to the field of power tools. In particular, the present invention relates to a power tool for setting anchors into a workpiece, such as concrete.

Description of the Related Art

Threaded drop-in anchors are usually manually set in concrete by drilling a hole and manually hammering the anchor into the concrete with a setting, tool. The setting tool is generally a male or pin-like tool that is sufficiently narrow to fit within the hole and fully strike one end of or inside of the anchor to set the anchor into the concrete. The setting tool is drive set to the shoulder of the concrete. Each size and type of anchor is installed using a setting tool supplied by its respective manufacturer. Therefore, there is a need in the art for a universal setting, tool capable of retaining bits of various sizes and types and capable of setting various anchors into workpieces.

Existing anchor setting with manual tools such as the pin-like tool and hammer combination are labor intensive. Further, there is a need in the art to accommodate a pin-like tool for continuous strike actions in a high energy level device for setting anchors.

SUMMARY OF THE INVENTION

A method and apparatus for retaining tool bits of various lengths and diameters in an impacting setting, tool that allows for a longitudinal translation of the bits. The bits are selectively removable and replaceable depending on the size of the anchor to be set. Thus, the tool sets anchors of various diameters and lengths and from multiple anchor manufacturers. The apparatus is in an electrically powered tool for use in driving the setting pins of threaded drop-in concrete anchors.

In an embodiment of the present invention, a bit retention device includes an upper support member having an inner surface and an outer surface and a lower support member fixed to the upper support member. A stationary plate can be mounted to the inner surface of the upper support member. A clamp plate can be operatively connected to the upper support member and opposing the stationary plate. The upper support member and the lower support member frame the stationary plate and the clamp plate. Also within the frame created by the upper support member and lower support member are a plurality of fixed clamp plate sleeves. The clamp plate sleeves are surrounded by corresponding clamp plate springs that resiliently bias the clamp plate toward the stationary plate.

The upper support member can have an elongated body that extends in a longitudinal direction within the tool housing. The elongated body can have sidewalls with a crenellated profile formed of upright sections and notches The stationary plate and clamp plate can have a plurality of laterally extending tabs that are arranged alternatingly in the longitudinal direction of the bit retention device, so that the clamp plate can move relative to the stationary plate for accommodating different diameters of tool bits. Additionally, the stationary plate and the clamp plate can have substantially V-shaped cross-sections that open toward each other to form a diamond shape for securing different diameters of tool bits therebetween.

In a further embodiment of the present invention, an anchor setting, tool includes above-described bit retention. The anchor setting tool can include a housing having a handle portion, a transmission portion and a forward portion. The bit retention device can be disposed at least partially within the forward portion for retaining a tool bit in a longitudinal direction and include a stationary plate, and a clamp plate biased toward the stationary plate. The tool further includes a motor powered by a power source, such as, for example, a battery, and a transmission mechanism arranged in the transmission portion and driven by the motor for converting rotary motion of the motor to linear motion of driving striking rod. The striking rod can be disposed in the forward portion between the transmission mechanism and the bit retention device. The striking rod can be moveable in a reciprocating manner from an impact received from the transmission mechanism to strike the tool bit.

A method for retaining a bit in a bit retention device having a longitudinally extending upper support member and a longitudinally extending lower support member encasing a clamp plate spring assembly includes providing a stationary plate mounted to the lower support member; providing a spring-biased clamp plate operatively connected to the upper support member and biased toward the stationary plate; and inserting a tool bit between the stationary plate and the clamp plate to move the clamp plate away from the stationary plate.

BRIEF DESCRIPTION OF THE DRAWINGS

The numerous advantages of the present invention may be better understood by those skilled in the art by reference to the accompanying Figures. In the drawings, like reference numerals designate corresponding parts throughout the several views.

DETAILED DESCRIPTION OF THE INVENTION

Reference will now be made in detail to the presently preferred embodiments of the invention, examples of which are illustrated in the accompanying drawings. FIGS. 5-9 illustrate an inverted, or top-side down, view of the bit retention device components for a clear view thereof.

Figure 1:
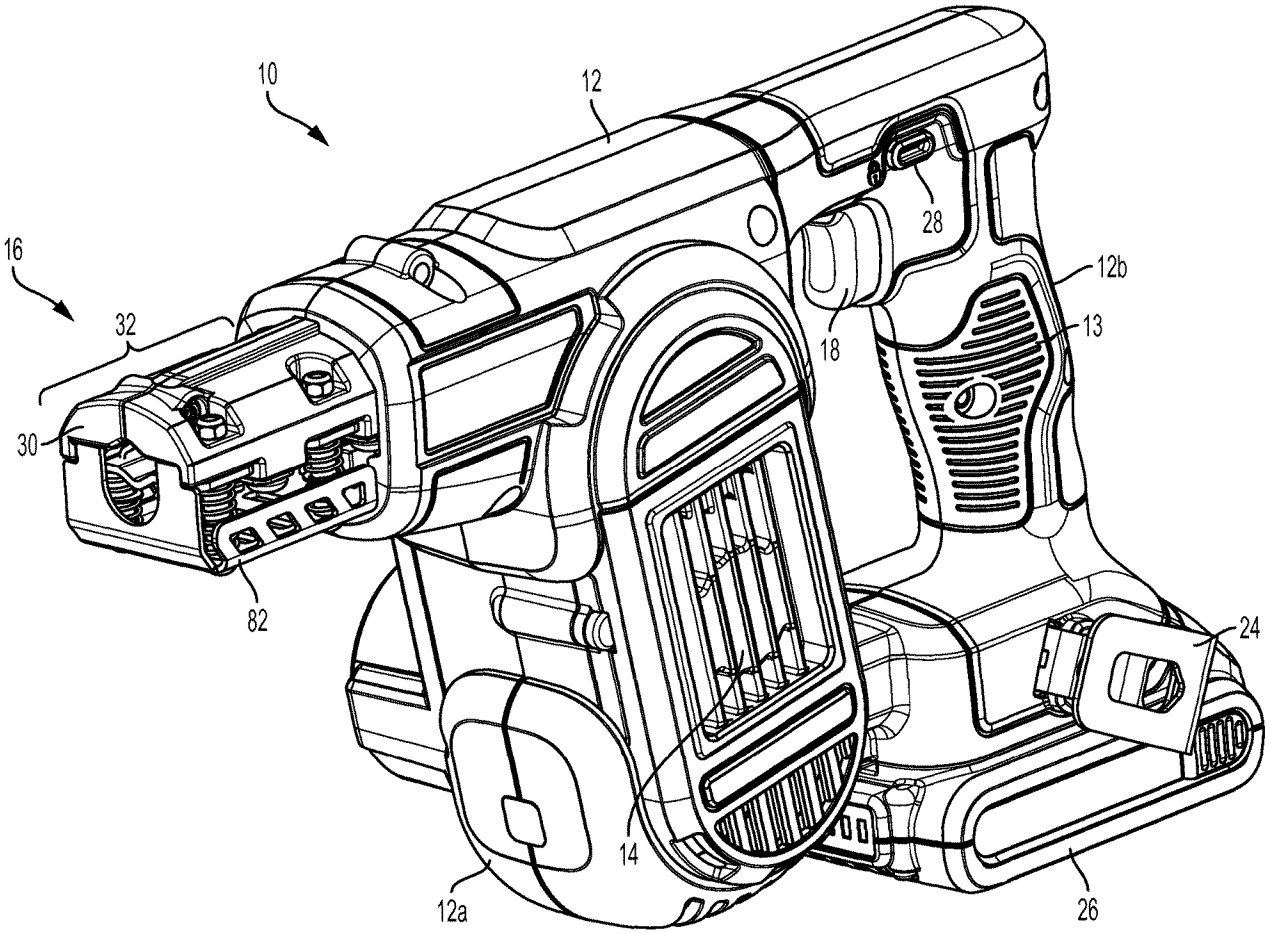
FIG. 1 illustrates a right perspective view of the anchor setting tool according to an embodiment of the invention.

Referring now more particularly to the drawings, FIG. 1 illustrates an anchor setting tool constructed in accordance with the teachings of the present invention.

Figure 2:
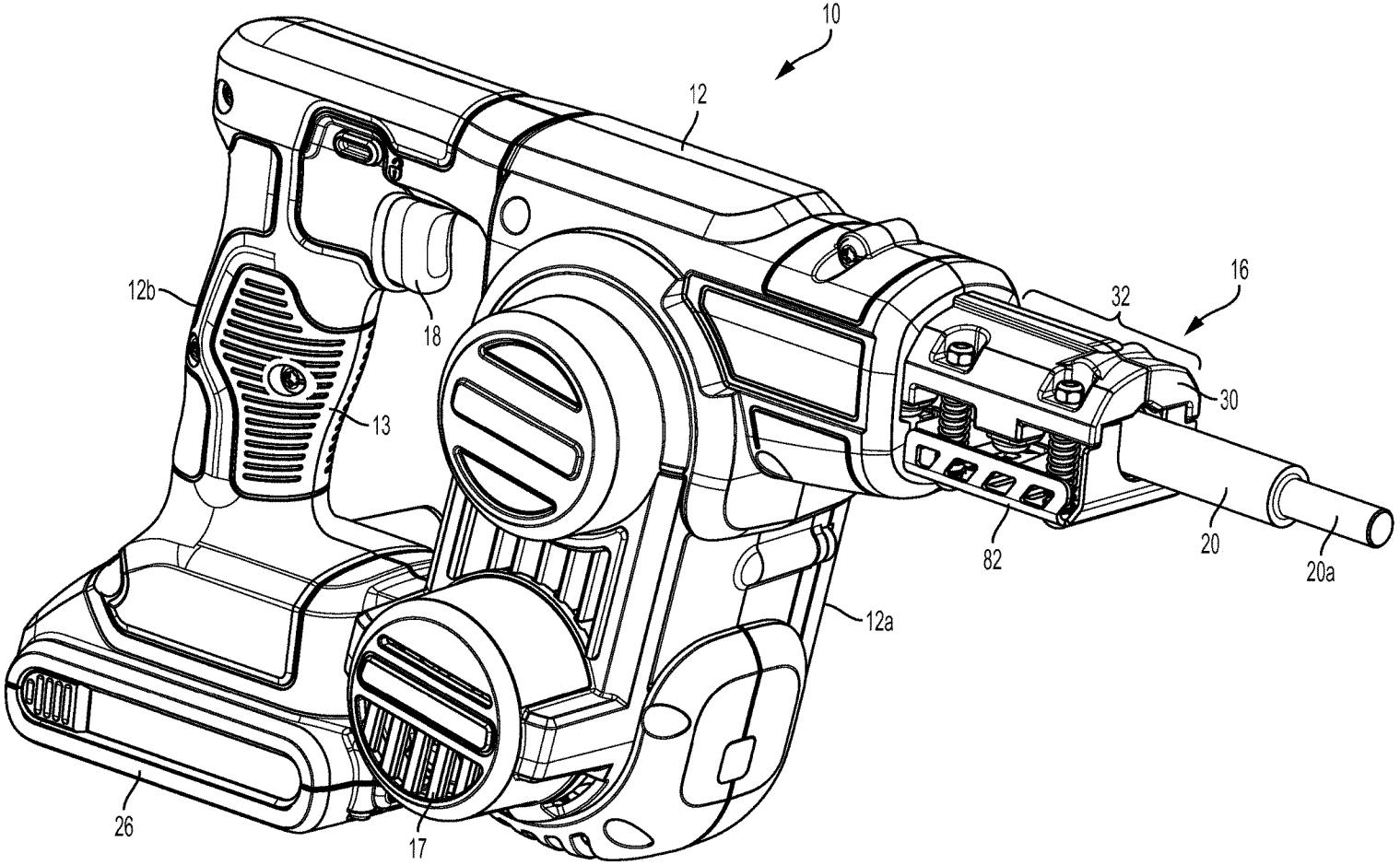
FIG. 2 illustrates a left perspective view of the anchor setting tool including a bit in the retention device according to an embodiment of the invention.
Figure 3:
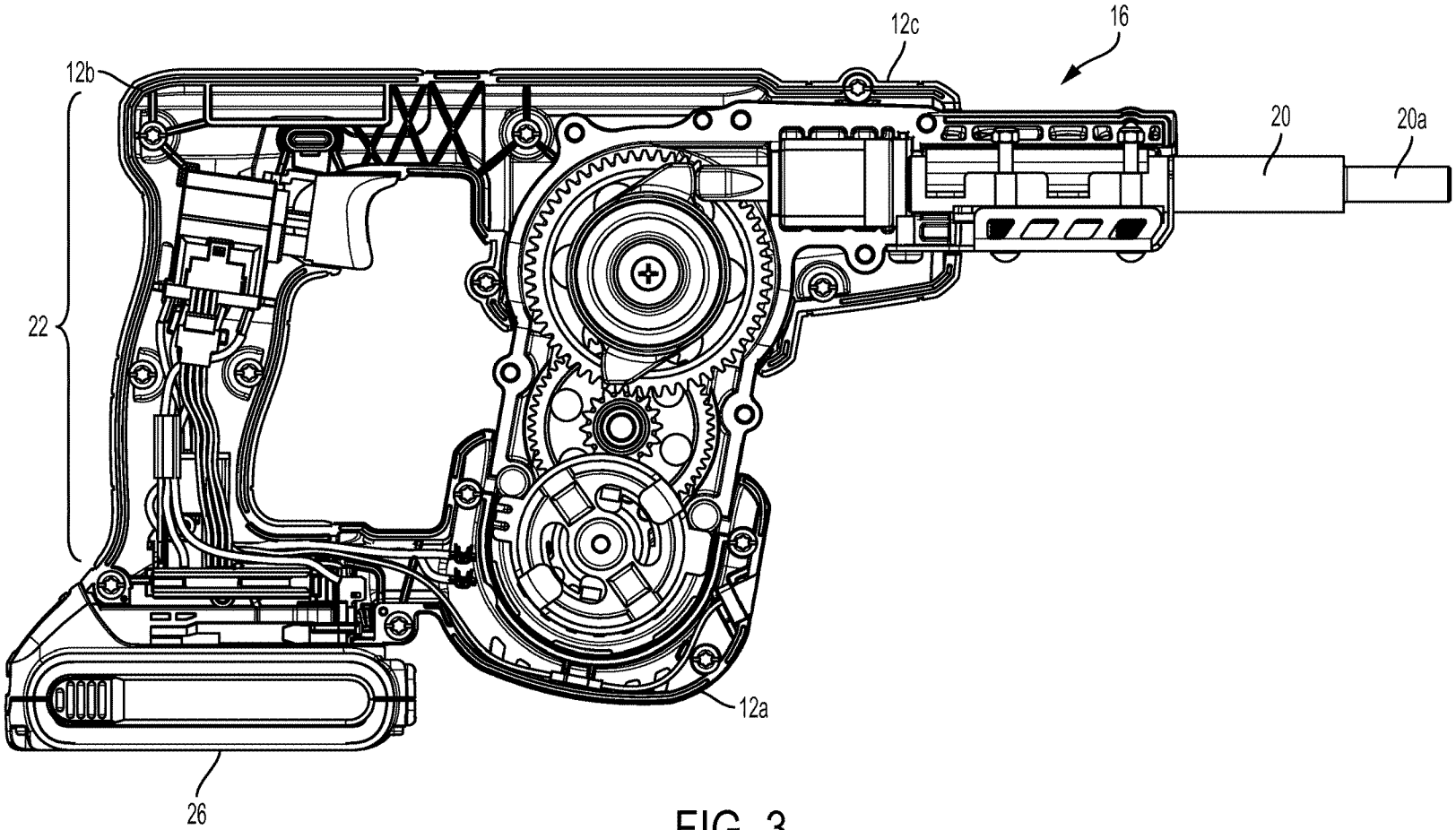
FIG. 3 illustrates a left side sectional view of the anchor setting tool according to an embodiment of the invention.
Figure 4:
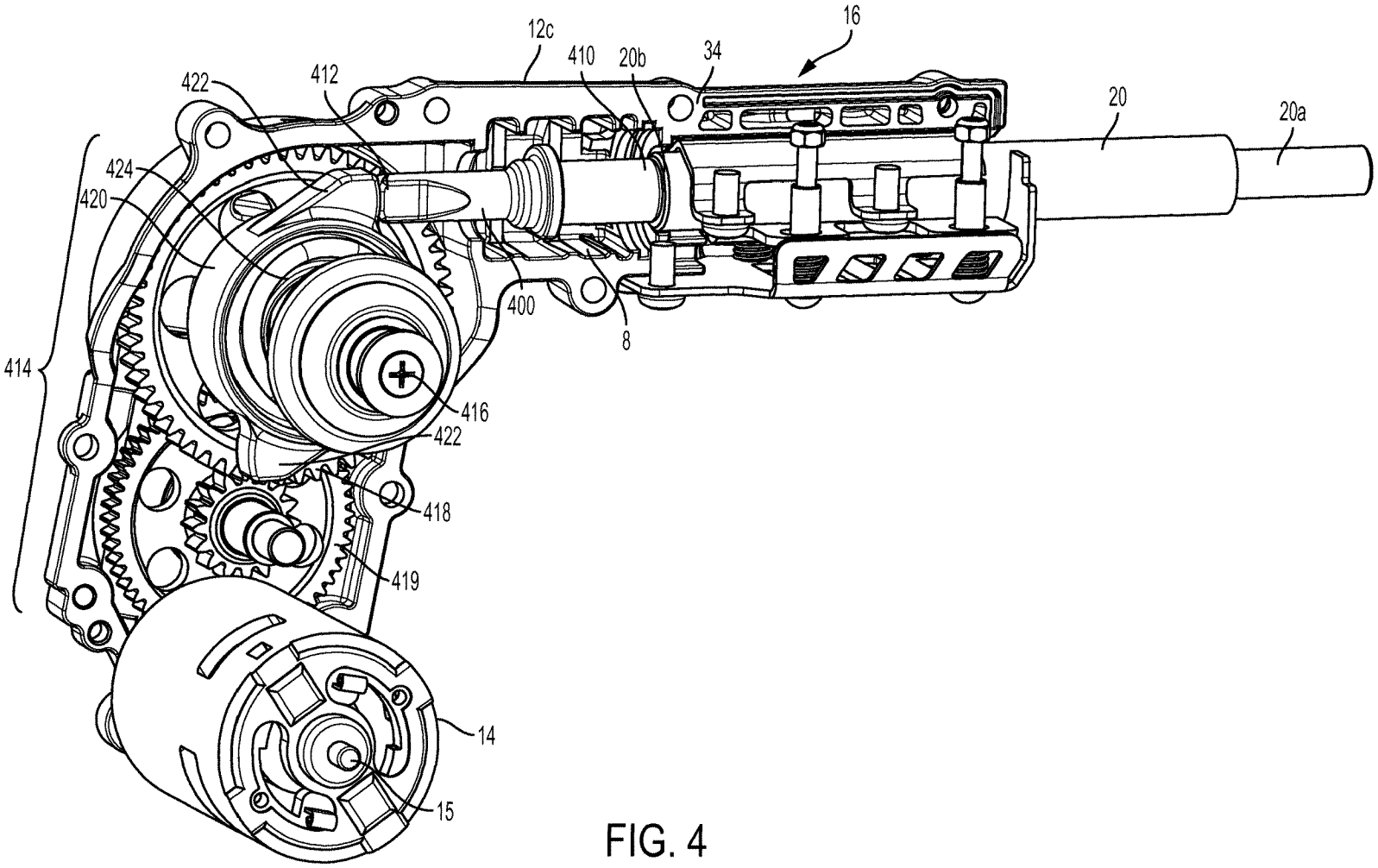
FIG. 4 illustrates a partial left side sectional view of the anchor setting tool.

With continuing reference to FIG. 1 and additional reference to FIGS. 2-4, the fastening, tool 10 may include a housing 12, a motor 14, a rotary-linear motion transmission mechanism 414, a bit retention device 16, a trigger 18, a control unit 22, and a battery 26, which provides electrical power to the motor assembly 14 and the control unit 22. Those skilled in the art will appreciate from this disclosure, however, that in place of, or in addition to the battery 26, the anchor setting tool 10 may include an external power cord (not shown) for connection to an external power supply (not shown). While the anchor setting tool is illustrated as being electrically powered by a suitable power source or energy storage device, such as the battery pack, those skilled in the art will appreciate that the invention, in its broader aspects, may be constructed somewhat differently and that aspects of the present invention may have applicability to pneumatically powered or corded anchor setting, tools. Furthermore, while aspects of the present invention are described herein and illustrated in the accompanying drawings in the context of an anchor setting tool, those of ordinary skill in the art will appreciate that the invention, in its broadest aspects, has further applicability, such as, for example, drilling, tools and impacting tools.

The housing 12 may include a body portion 12*a*, which may be configured to house the motor 14 and transmission mechanism 414, and a handle 12*b*. The housing body portion 12*a* is vertically arranged in the housing 12 and has an upper portion and a lower portion. The lower portion of the housing includes the motor exhaust 17. The handle 12*b* may be configured to house the control unit 22. The handle 12*b* may provide the housing 12 with a conventional pistol-grip appearance and may be unitarily formed with the body portion 12*a* or may be a discrete fabrication that is coupled to the body portion 12*a*, as by threaded fasteners (not shown). The handle 12*b* may be contoured so as to ergonomically fit a user's hand and/or may be equipped with a resilient and/or non-slip covering, such as an overmolded thermoplastic elastomer 13.

The trigger 18 may be coupled to the housing 12 and is configured to receive an input from the user, typically by way of the user's finger, which may be employed in conjunction with a trigger switch 18*a* to generate a trigger signal that may be employed in whole or in part to initiate the cycling of the tool 10 to strike the striking rod 400 and, in turn, the tool bit 20, and anchor (not shown). The setting pin portion 20*a* is inserted into the anchor such that when the tool bit 20 is struck by the striking rod 400, the tool bit moves longitudinally within the bit retention device 16 to strike the body of the anchor and wedge the anchor into a workpiece, such as concrete.

FIG. 1 also illustrates a hang, hook 24 for hanging the tool 10 from a suspended surface. Further illustrated is a lock-off bar 28 that selectably prevents the trigger 18 from being depressed.

FIG. 3 illustrates an exemplary control system 22. The control system 22 controls the supply of power from the power source, such as the battery 26, to the motor 14 as disclosed in U.S. patent application Ser. No. 13/080,712 assigned to Black & Decker, Inc. of Newark, Del., which is hereby incorporated by reference in its entirety.

As shown in FIGS. 2-4, the bit retention device 16 retains a tool bit 20 having a setting pin portion 20*a* and striking end 20*b*. As will be discussed, tool bits 20 are retained within the bit retention device 16 by a combination of plates and springs that move along rigid sleeves to accommodate bits having different thicknesses.

With reference to FIGS. 3 and 4, the trigger 18 is arranged on the housing 12 for controlling the motor 14. A forward portion 12*c* of the housing 12 can be in the form of a barrel 8 arranged substantially perpendicular to the body portion 12*a*. A striking rod 400 is mounted longitudinally within the barrel 8 for striking the tool bit 20, with a restoring spring 424 for returning the striking rod back to its original position after striking the tool bit. The striking rod 400 is moved in a reciprocating manner within the barrel 8. The striking rod 400 is shaped generally like a shaft, including a first end 410 for striking the tool bit 20 and a second end 412 to be impacted. During operation, the striking rod 400 is driven to move and the first end 410 acts on a striking end 20*b* of the tool bit 20. The forward portion 12*c* of the housing 12 further includes the bit retention device 16 which is provided with a clampable opening for containing the tool bit 20.

As further shown in FIGS. 3 and 4, a multi-stage gear transmission mechanism 414, which can be a rotary-linear motor transmission mechanism, is arranged in the housing body portion 12*a* for converting rotating motions of the motor 14 into impact motions of the striking rod 400. The motor 14 is mounted perpendicularly within the housing body portion 12*a*, and has a horizontal motor shaft 15 connected to the input end of the multi-stage gear transmission mechanism 414, including bevel gears. In this way, the rotation power of the motor 14 is transmitted to a rotating shaft 416 which is mounted in the upper portion of the housing body portion 12*a* by two bearings. In an exemplary embodiment, the rotating shaft 416 is driven by a gear 418 which is driven indirectly, for example, through gear 419, by the motor shaft 15. The power output end of the multi-stage gear transmission mechanism 414 is mated with the striking rod 400.

Optionally, a pair of inclined slots (not shown) is formed on the rotating shaft 416. An impact wheel 420 is mounted on the rotating shaft 416. Optionally, the impact wheel 420 comprises a pair of guiding slots (not shown) which are formed on its inner wall and opposite to the inclined slots (not shown) respectively. As a further option, a pair of steel balls (not shown) can be arranged movably in two chambers formed by the inclined slots and the guiding slots. When the inclined slots are moved relative to the guiding slots, the chambers formed thereby are moved with a result that the steel balls can be moved along with the chambers. The impact wheel 420 can thus be driven to rotate through the steel balls within the inclined slots when the rotating shaft 416 is rotated.

A pair of projections 422, which extend along the diameter direction of the impact wheel 420, is provided on the periphery of the impact wheel. An energy storing spring 424 is mounted between the impact wheel 420 and the rotating shaft 416 in manner so that one end of the energy storing spring 424 abuts to a shoulder of the rotating shaft 416 and the other end of the energy storing spring 424 abuts to a side surface of the impact wheel 420. Under an axial biasing force of the energy storing spring 424 acting upon the impact wheel 420 along the axial direction of the rotating shaft 416, the impact wheel 420 is located at a first axial position relative to the rotating shaft 416. In the first axial position, the impact wheel 420 rotates in a circle on the rotating shaft 416 and the steel balls. When the impact wheel 420 is rotated to a position where the projections 422 contact the second end 412 of the striking rod 400, and the striking rod 400 encounters a larger resistance that is difficult to overcome provisionally, the impact wheel 420 is temporarily stopped from rotating by the striking rod 400, so that the impact wheel 420, with the cooperation of the steel wheels, guiding slots and inclined slots, overcomes the axial force of the spring 424, compresses the energy storing spring 424 and moves from the first axial position to a second axial position relative to the rotating shaft 416. At the second axial position, the projection 422 of the impact wheel 420 departs from the striking rod 400, and the stopping is released. In this case, the energy storing spring 424 starts to release its elastic potential energy. Under a function of rebound axial force of the energy storing spring 424, the impact wheel 420 is pressed back to its first axial position quickly, and is moved at a higher speed than that of the rotating shaft 416 with the cooperation of the inclined slots, guiding slots and steel wheels. As a result, the second end 412 of the striking rod 400 is impacted by the projections 422 of the impact wheel 420 to move at a high speed in a direction away from the projections 422, and the striking rod 400 strikes the end face 20*b* of the tool bit 20 quickly. In this way, a strike action is achieved. When the impact wheel 420 is continuously driven to rotate and to be stopped by the striking rod 400, the wheel enters into succeeding cycles, which will be achieved in the same manner.

Additional features of the motor and transmission mechanism are disclosed in U.S. Pat. No. 8,439,243, which is hereby incorporated by reference in its entirety.

Referring now to FIGS. 5-10, a bit retention device will be described. In an embodiment of the present invention, the bit retention device 16 includes an upper support member, a lower support member 2 coupled to the upper support member, a stationary plate 60 suitably mounted to the upper support member, a spring-loaded clamp plate 70 slidably mounted to the upper support member, and a clamp plate spring assembly 78. The upper support member and the lower support member, together, encase the stationary plate 60, clamp plate 70 and clamp plate spring assembly 78. The stationary plate 60 and clamp plate 70 releasably secure the tool bit 20 within the bit retention device 16.

Figure 5:
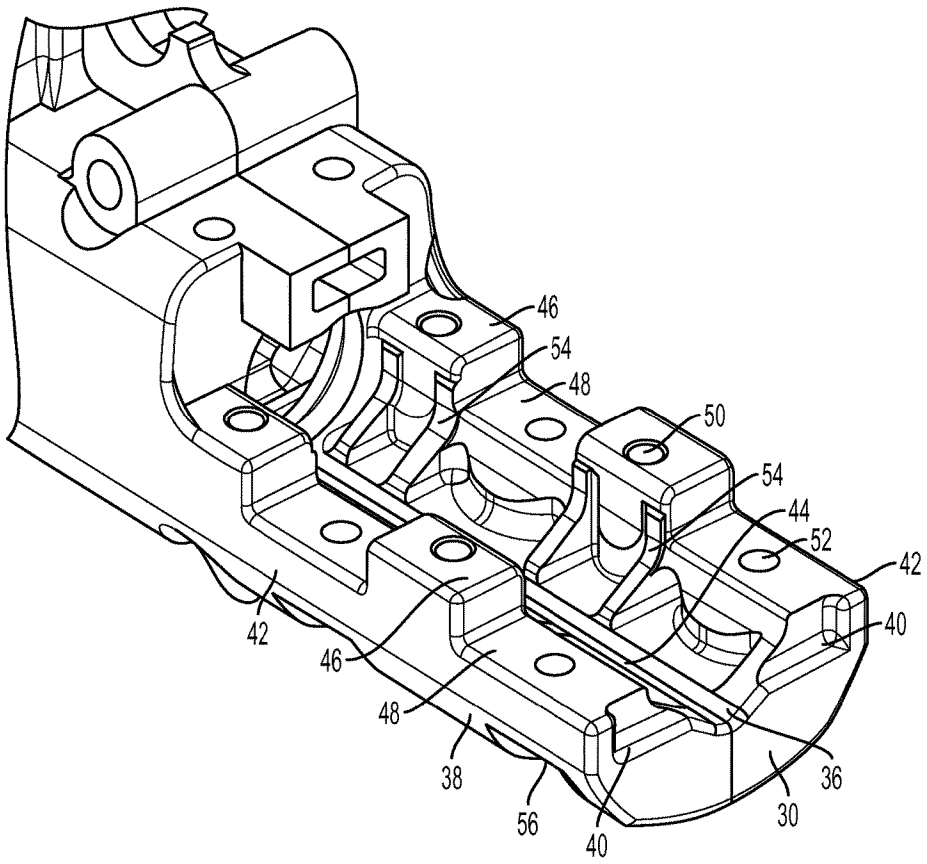
FIG. 5 illustrates a perspective view of the shroud of the bit retention device according to an embodiment of the invention.

As shown in FIGS. 1, 2 and 5, the upper support member can be in the form of a shroud 30 disposed within the forward portion 12*c* of the housing 12. The forward portion 12*c* can extend perpendicularly to the body portion 12*a*. The shroud 30 can be secured within an opening in the forward portion 12*c* of the housing 12 by means including, but not limited to, fasteners. The shroud 30 can have an elongated body with a front portion 32 and rear portion 34 arranged in the longitudinal direction of the forward portion 12*c*, an inner surface 36, and an outer surface 38. The shroud 30 can be insertably mounted within the forward portion 12*c* of the housing 12 and secured to the housing 12 at the rear portion 34 by fasteners. The front portion 32 of the shroud 30 cantilevers from the opening in the forward portion 12*c* and forms the support for the stationary plate 60, clamp plate 70 and clamp plate spring assembly 78 of the bit retention device 16.

The front portion 32 of the shroud 30 includes notched surfaces 40 for retaining a front portion of the lower support surface.

As illustrated, for example, in FIG. 5, the front portion 32 of the shroud 30 can be formed with opposing lateral side walls 42 and the inner surface 36 can be formed as a valley 44 therebetween. The lateral side walls 42 can have a crenellated profile formed of alternating upright sections 46 and notches 48 extending in a direction perpendicular to the longitudinal direction of the shroud 30. As shown, the notch sections 48 have a height that is shorter than the height of the upright sections 46. The upright sections 46 and notches 48 of one side of the shroud can be laterally opposite to the upright sections and notches of the opposite side wall. The upright sections 46 and notches 48 can be of equal longitudinal length. Alternatively, the upright sections 46 can have a different length from the notch sections 48. For example, the upright sections 46 of the shroud 30 can be longer or shorter than the notch sections 48. The crenellated profile provides a mounting surface for portions of the stationary plate, as discussed below.

Blind holes 50 can be provided in upright sections 46. The blind holes 50 allow for securing, the stationary plate to the upright sections 46. Additionally, the notch sections 48 have threaded apertures 52 for inserting components of the clamp plate spring assembly. Inner surfaces 36 of the shroud 30 can have ribbed surfaces 54 integrally formed with the upright sections 46. The ribbed surfaces 54 support the stationary plate within the shroud 30. The left side of the shroud 30 in FIG. 5 is the mirror image of the right side.

The valley portion 44 of the shroud 30 has a V-shape as a main or central component of the cross-section. The V-shape of the shroud provides a controlled surface for the location of the various cylindrical anchor setting, bits.

Figure 10:
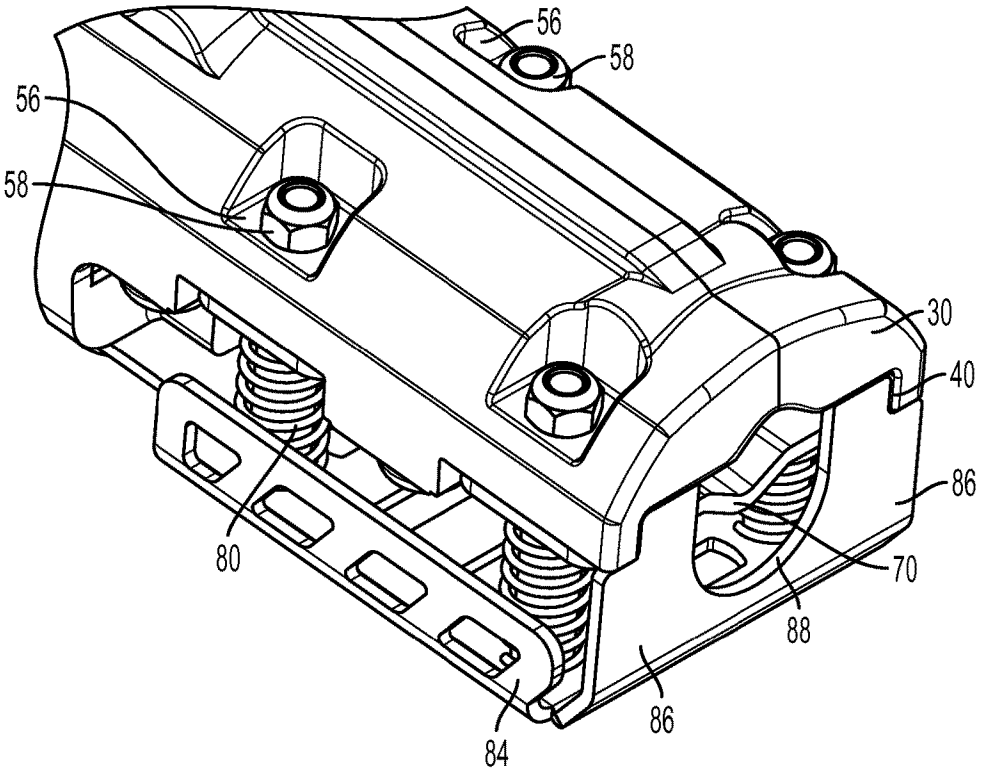
FIG. 10 illustrates a perspective view of the bit retention device.

As shown in FIG. 5 and more clearly in FIG. 10, the outer surface 38 of the shroud 30 includes a plurality of recesses or pockets 56 aligned with the notch sections 46 of the lateral side walls 42. The recesses or pockets 56 house securing, members 58, such as internally threaded nuts, that secure the clamp plate spring assembly to the shroud 30.

The shroud can be formed from steel, sheet metal, or materials such as plastic, magnesium and aluminum.

Figure 6:
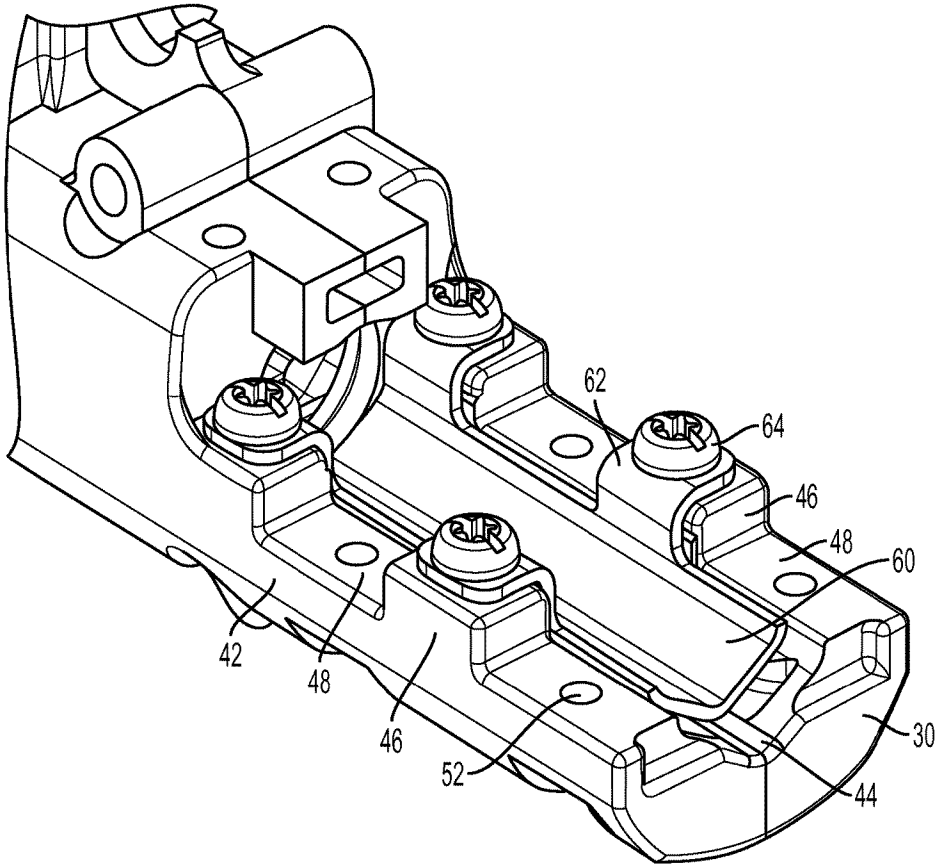
FIG. 6 illustrates a perspective view of the stationary plate of the bit retention device according to an embodiment of the invention.

In an embodiment of the present invention, shown, for example, in FIG. 6, the stationary plate 60 is mounted to the valley portion 44 on the inner surface 36 of the shroud 30. The stationary plate 60 serves to align the tool bit 20 in the shroud. The stationary plate also provides a reinforced surface in the shroud 30 against which the tool bit 20 bears when the tool bit is inserted in the bit retention device. The stationary plate 60 has an elongated body aligned with the longitudinal direction of the shroud 30. The stationary plate 60 has a V-shape as a main or central component of the cross-section that corresponds to the contours of the V-shaped portion of the cross-section on the inner surface 36 of the shroud 30.

In addition to the V-shape portion of the cross-section, the stationary plate 60 also includes a plurality of tabs 62 through which a threaded fastener 64 can secure the stationary plate, through the blind holes 50, to the upright sections 46 of the shroud 30. The tabs 62 can be formed to project radially inward from an inner surface of the stationary plate 60 and to fold over the upright sections 46 of the shroud 30. The tabs 62 can be arranged in laterally opposing pairs, that is, on opposite sides of the valley 44 in the shroud 30. The stationary plate 60 can be formed from any material including but not limited to, hardened steel.

Figure 7:
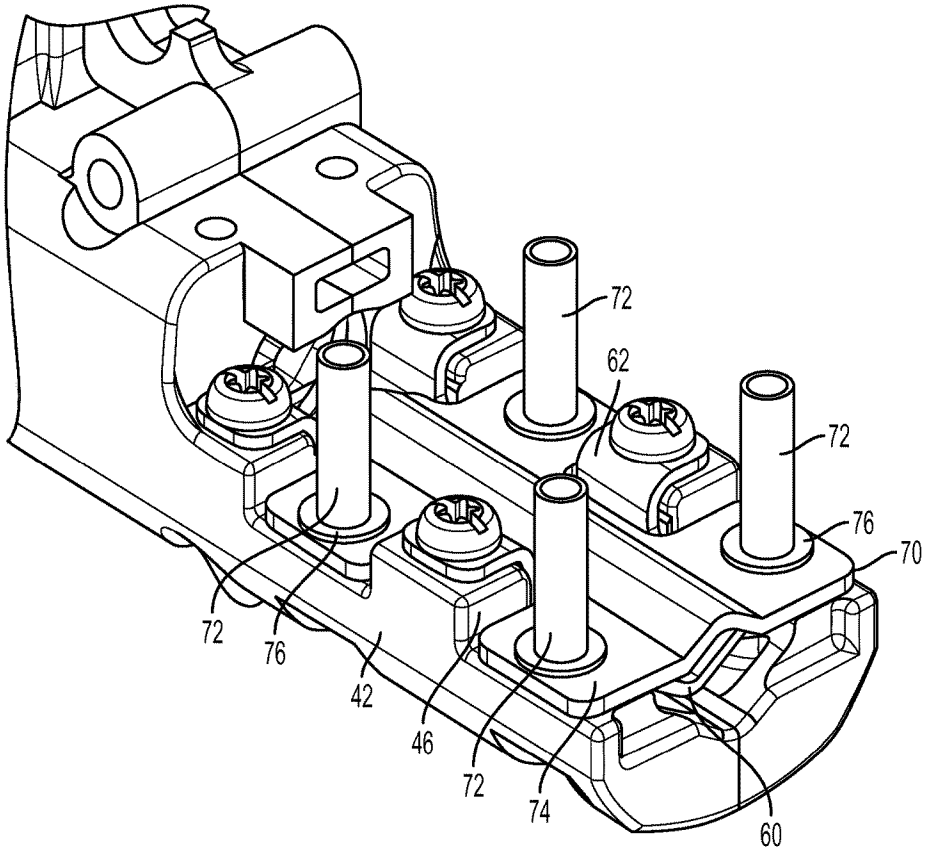
FIG. 7 illustrates a perspective view of the clamp plate and clamp members of the bit retention device according to an embodiment of the invention.

In an embodiment of the present invention, shown, for example in FIG. 7, a spring-loaded clamp plate 70 is operatively connected to the shroud 30 for relative movement therewith. The clamp plate 70 can be an elongated member that extends along the longitudinal direction of the shroud 30 and stationary plate 60. The clamp plate 70 is mounted on an opposite side of the stationary plate 60 from the shroud 30. The spring-loaded clamp plate 70 floats between the shroud 30 and the lower support member on a plurality of rigid clamp plate sleeves 72. The clamp plate 70 has a V-shape as a main component of the cross-section. The open portion of the V faces the open portion of the V-shape of the stationary plate 60. As a result, the V-shaped cross-section of the clamp plate aligned with the V-shaped cross-section of the stationary plate forms a diamond-shaped opening for inserting a bit into the bit retention device 16. The V-shaped portion of the clamp plate 70 provides a controlled surface for the location of the various sized, usually cylindrical, anchor setting bits. The clamping force between the stationary plate 60 and the clamp plate 70 provides the retention needed to keep the anchor setting tool bits attached to the power tool. Alternatively, the clamp plate element may be retained by a mechanical or electrically operated clamp.

Another structural characteristic of the clamp plate 70 is that the front end of the clamp plate can be non-parallel. As shown for example in FIGS. 7-9, the clamp plate front end extends beyond the front end of the stationary plate in the direction of the setting pin 20*a*. Such a configuration allows the tool bit 20 to leverage the more extended length as a support for easier installation. Alternatively, the front end of the stationary plate can extend beyond the front end of the clamp plate.

The clamp plate 70 also includes a plurality of tabs 74 that are aligned with the notch sections 48 of the shroud 30. The clamp plate tabs 74 extend laterally from the center portion of the clamp plate. The clamp plate 70 can have an aperture in each tab 74 that is axially aligned with the threaded apertures 52. The tabs 74 are arranged in a longitudinal direction of the shroud 30. At rest, the tabs 74 of the clamp plate are flush with horizontal surface portions of the upper support member 46. Stationary posts or clamp plate sleeves 72 are inserted into the apertures in the clamp plate 70 and the shroud to locate the clamp plate relative to the shroud. The clamp plate can be constrained in the tool by one or more clamp plate sleeves that are aligned to the shroud 30 by means of fasteners.

Additionally, the clamp plate sleeves 72 constrain movement of the clamp plate 70 to move only vertically with respect to the shroud. The tabs 74 alternate with the tabs 62 of the stationary plate 60 along the lateral wall 42 of the shroud 30.

The clamp plate 70 can also have a lead-in surface of alternate cross-section that guides the tool bit into the power tool.

In an embodiment, clamp washers 76 can be secured to the clamp plate 70 around the clamp plate apertures. The clamp washers 76 may be placed between the clamp plate springs and the clamp plate. The clamp washer 76 serves to distribute the load and create a rest surface for the springs, such as, for example, when the springs are compressed by entry of the tool bit into the bit retention device.

The clamp plate 70 can be formed from any material including but not limited to hardened steel and sheet metal.

Figure 8:
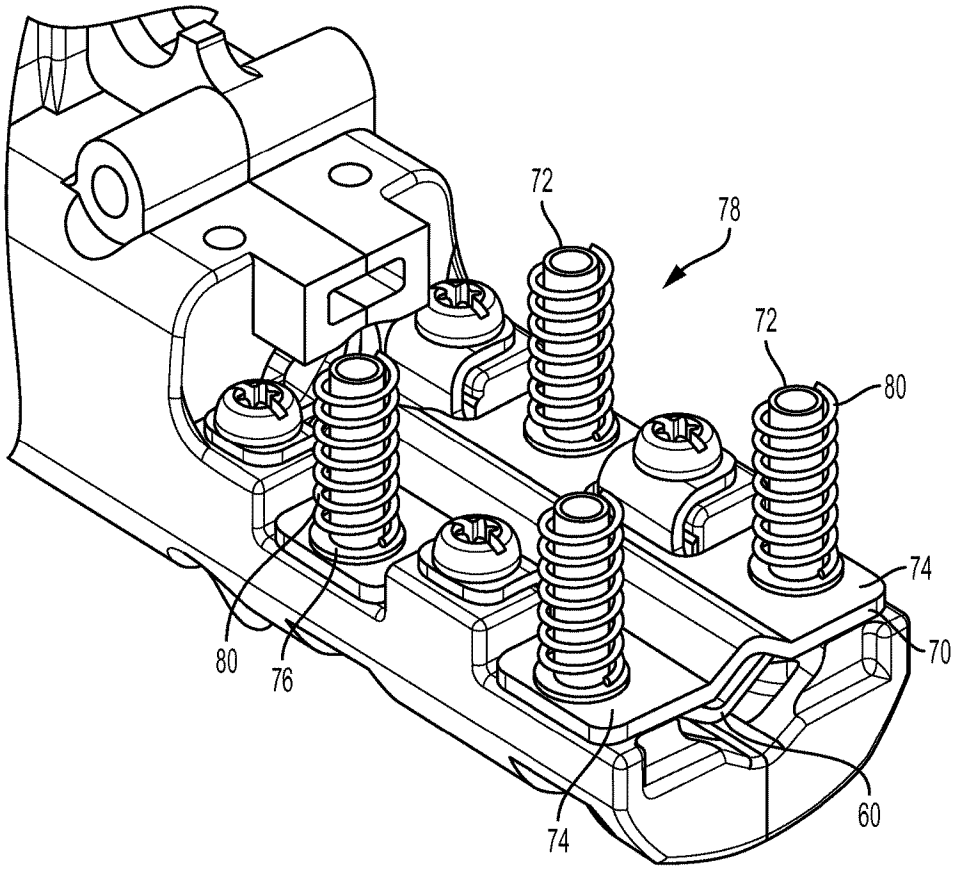
FIG. 8 illustrates a perspective view of the clamp plate spring, assembly of the bit retention device according to an embodiment of the invention.

In an embodiment, shown in FIG. 8, for example, the clamp plate 70 can be slidably attached to the shroud 30 through one or more stationary posts or clamp plate sleeves 72. The clamp plate sleeves 72 are provided to constrain the motion of the clamp plate 70. The clamp plate sleeves 72 can be elongated members that extend perpendicularly inward with respect to the longitudinal direction of the clamp plate 70. In an embodiment, a plurality of clamp plate sleeves 72 allows the clamp plate 70 to move freely in a vertical direction with respect to the shroud 30 and stationary plate 60. Specifically, the clamp plate sleeves 72 allow the clamp plate 70 to slidably move toward and away from the shroud 30 and stationary plate 60. The clamp plate sleeves 72 are inserted into the clamp plate apertures and corresponding, threaded apertures 52 of the shroud 30. The ends of the clamp plate sleeves 72 extend through the shroud 30 into the shroud recess or pocket 56 where the ends of the sleeves encircle bolts that are threadedly secured into the shroud 30, as shown in FIG. 10. As such, the clamp plate sleeves are fixed in place and act as spacers between the stationary plate 60 and clamp plate 70, wherein the clamp plate moves axially on the clamp plate springs 80. The clamp plate sleeve 72 and clamp washers 76 can be formed from any material, including but not limited to steel.

In an embodiment of the present invention, as shown in FIG. 7, the clamp plate sleeve 72 can be hollow such that a fastening member can pass through the sleeve and into the shroud 30. Fastening members include, but are not limited to screws. In an embodiment, the clamp plate sleeves 72 can be tubular as shown in FIG. 7, for example. Alternatively the clamp plate sleeves 72 can have a cross-section that is rectangular, triangular, oval or any other suitable shape that corresponds to the aperture in the clamp plate.

The clamp plate sleeves 72 prevents the clamp plate 70 from shifting sideways with respect to the shroud 30 when the clamp plate moves vertically along the clamp plate sleeve and when the clamp plate and stationary plate 60 are holding a tool bit 20.

In an embodiment shown in FIG. 8, the clamp plate spring assembly 78 includes one or more biasing members or clamp plate springs 80 that apply a force to the clamp plate 70 such that the clamp plate is resiliently connected to the shroud 30. The reactionary elements or coils of the clamp plate spring 80 are in contact with the clamp plate 70. The clamp plate springs 80 provide a clamping force between the clamp plate and the stationary plate. The clamping force provides the retention needed to keep the anchor setting tool bits attached to the power tool.

The clamp plate springs 80 can be mounted between the clamp plate 70 and the lower support member. In an embodiment of the present invention, the clamp plate spring 80, such as, for example, helical compression springs, are disposed around the clamp plate sleeves 72 to provide a clamping force against the clamp plate 70 to hold the tool bit 20. The clamp plate springs 80 provide resistance against movement of the clamp plate 70 toward the lower support member by biasing the clamp plate in the direction of the stationary plate 60.

The clamp plate springs 80 may be of various types including, but not limited to coil springs, torsion springs, and leaf springs. Although helical coil springs are illustrated, the clamp plate element may alternatively be retained by a mechanical or electrically operated clamp.

When a tool bit 20 is inserted along the longitudinal axis of the shroud 30 between the stationary plate 60 and the clamp plate 70, the diameter of the tool bit radially displaces the clamp plate 70 away from the stationary plate 60. In addition, the resistance provided by the clamp plate springs 80 ensures an interference fit of the tool bit 20 between the stationary plate 60 and the clamp plate 70.

Figure 9:
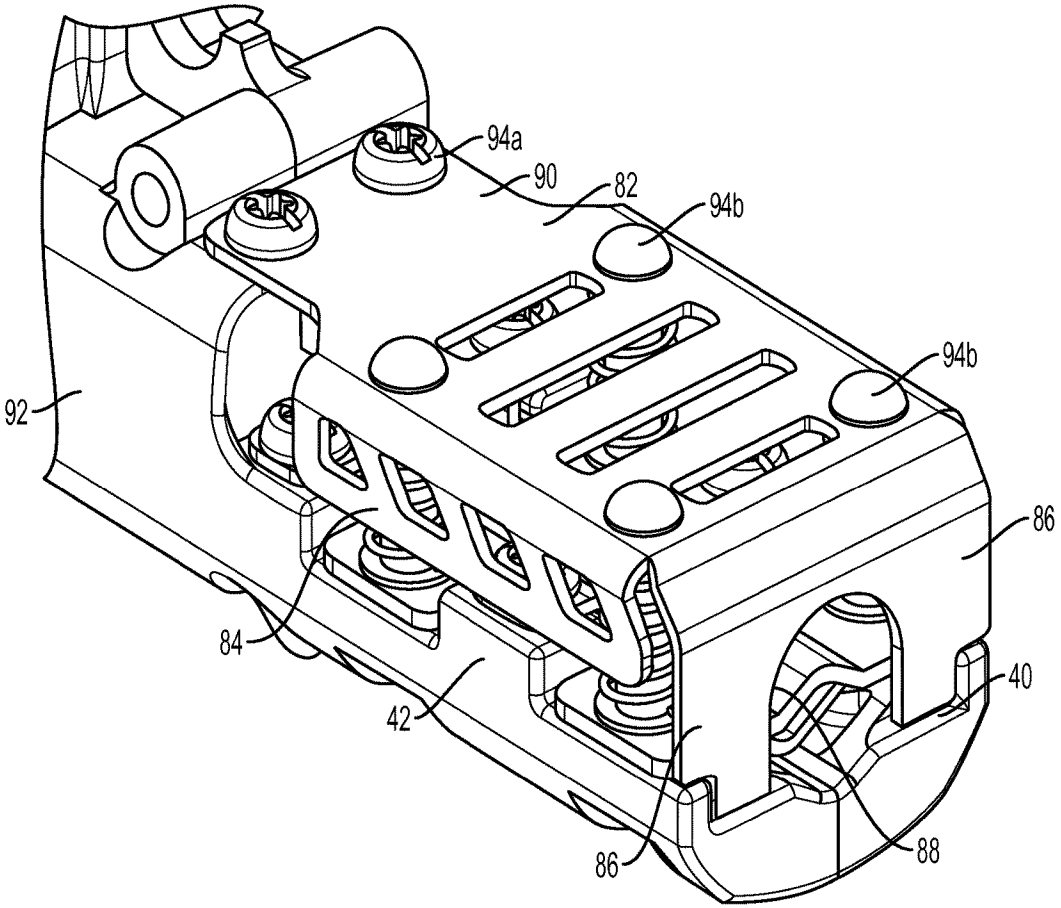
FIG. 9 illustrates a perspective view of the bit retention device cage according to an embodiment of the invention.

In an embodiment of the present invention as shown in FIG. 9, the lower support member or cage 82 is attached to the shroud 30 to create an enclosure around the stationary plate, clamp plate and clamp plate spring assembly. The cage 82 is stationary and serves as the reaction surface for the clamp plate springs 80. The cage 82 has a substantially planar body with side guard 84 and front guard 86 portions that project toward the shroud 30. The guard portions 84, 86 serve to protect the clamp plate springs 80 from damage. The front guard portions 86 are on a front face of the cage 82. The front face of the cage 82 includes a central opening 88 for receiving the tool bit 20 into the bit retention device 16.

The cage 82 has apertures therethrough for inserting fastening elements to secure the cage to the shroud 30.

As shown in the cross-sectional view of FIG. 3 and in FIG. 9, a rear portion of the cage 90 and a rear portion of the shroud 92 are disposed within the forward portion 12*c* of the housing 12. The rear portion 90 of the cage 82 is connected to the rear portion 92 of the shroud by threaded screws 94*a* or the like, while the front end portion of the cage 82 rests in the notched front surfaces 40 of the shroud. The forward portion of the cage can be bolted to the shroud through the clamp sleeves 72 with steel screws, threaded screws 94*a* or bolts 94*b*. The ends of the bolts or steel screws project through the threaded apertures in the upper surface of the shroud 30 into the shroud recesses 56 where they can be secured in place by a fastening element, such as a nut. The cage 82 can be formed from any material including but not limited to hardened steel, standard steel, and aluminum.

Replaceable inserts or anchor setting bits having various diameters and lengths are retained during use of the tool. Changing between different sized tool bits is made easier and faster than in existing bit retention devices. Although a cylindrical tool bit is illustrated, the bits can be of any shape including but not limited to rectangular, triangular and oval. The spring-loaded clamp plate and clamp plate spring assembly automatically adjusts and applies a retaining force to accommodate different sizes of bits. As a result, no tools are needed to load or unload the tool bits.

While aspects of the present invention are described herein and illustrated in the accompanying drawings in the context of a fastening, tool, those of ordinary skill in the art will appreciate that the invention, in its broadest aspects, has further applicability.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

We claim:

1. A bit retention device comprising:

an upper support member having an inner surface and an outer surface;

a lower support member fixed to the upper support member;

a stationary plate mounted to the inner surface of the upper support member; and a clamp plate opposing and spring-biased toward the stationary plate, the clamp plate being slidably moveable between the upper support member and the lower support member.

2. The bit retention device according to claim 1, further comprising a plurality of clamp plate sleeves fixed between the upper support member and the lower support member and surrounded by corresponding clamp plate springs, the clamp plate springs resiliently biasing the clamp plate toward the stationary plate.

3. The bit retention device according to claim 2, wherein the clamp plate sleeves are rigid.

4. The bit retention device according to claim 1, wherein the upper support member has an elongated body extending in a longitudinal direction and crenellated side walls.

5. The bit retention device according to claim 4, wherein the stationary plate comprises tabs projecting radially inward and folded over upright sections of the crenellated side walls of the upper support member.

6. The bit retention device according to claim 5, wherein the clamp plate comprises tabs that, in the longitudinal direction of the upper support member, alternate with the tabs of the stationary plate.

7. The bit retention device according to claim 1, wherein the stationary plate has a substantially V-shaped cross-section.

8. The bit retention device according to claim 7, wherein the clamp plate has a substantially V-shaped cross-section that opposes the substantially V-shaped cross-section of the stationary plate.

9. The bit retention device according to claim 1, wherein the stationary plate and clamp plate have front ends and, wherein the front end of the stationary plate is non-parallel to the front end of the clamp plate.

10. The bit retention device according to claim 9, wherein the front end of the clamp plate front end extends beyond the front end of the stationary plate.

11. The bit retention device, according to claim 1, wherein the lower support member comprises guard portions that project from a lower surface thereof toward the upper support member.

* * * * *